United States Patent [19]

Fushikida

[11] Patent Number: 4,486,899

[45] Date of Patent: Dec. 4, 1984

[54] SYSTEM FOR EXTRACTION OF POLE PARAMETER VALUES

[75] Inventor: Katsunobu Fushikida, Tokyo, Japan

[73] Assignee: Nippon Electric Co., Ltd., Tokyo, Japan

[21] Appl. No.: 358,638

[22] Filed: Mar. 16, 1982

[30] Foreign Application Priority Data

Mar. 17, 1981 [JP] Japan ..... 56-37264
Aug. 10, 1981 [JP] Japan ..... 56-124095

[51] Int. Cl.[3] ..... G10L 1/00
[52] U.S. Cl. ..... 381/36
[58] Field of Search ..... 381/36–50; 364/513.5

[56] References Cited

U.S. PATENT DOCUMENTS 3,610,831 10/1971 Moshier ..... 381/43

OTHER PUBLICATIONS

"Automatic Formant Tracking by a Newton–Raphson Technique", by J. P. Olive, The Journal of the Acoustical Society of America, vol. 50, No. 2, (Part 2), 1971, pp. 661–670.

"Digital Inverse Filtering—A New Tool for Formant Trajectory Estimation", by J. D. Markel, IEEE Transactions on Audio and Electroacoustics, vol. AU-20, No. 2, Jun. 1972, pp. 129–136.

"A Single-Chip Digital Signal Processor for Voice-band Applications", by Yuichi Kawakami et al., 1980 IEEE International Solid-State Circuits Conference.

*Primary Examiner*—E. S. Matt Kemeny
*Attorney, Agent, or Firm*—Blakely, Sokoloff, Taylor & Zafman

[57] ABSTRACT

There is disclosed a system for the extraction of pole parameter values. The system comprises an autocorrelation value calculating circuit receiving an input voice signal through a time window, for calculating an autocorrelation value $V_i$(i=0, 1, 2, . . .) of the input voice signal within the time window; a linear prediction coefficient memory circuit for storing linear prediction coefficients ($\alpha_1$, $\alpha_2$) corresponding to various pole parameter values; a signal processor for receiving as its input the output value $V_i$ of the autocorrelation value calculating circuit, performing thereon an arithmetic operation according to the following formula using the prediction coefficients ($\alpha_1$, $\alpha_2$) supplied by the linear prediction coefficient memory circuit:

$$r_i=(l+\alpha_1^2+\alpha_2^2)V_i-(\alpha_1-\alpha_1\alpha_2)V_{i+1}-(-\alpha_1-\alpha_1\alpha_2)V_{i-1}-\alpha_2 V_{i-2}-\alpha_2 V_{i+2}$$

and delivering an output ($r_i$) representative of an autocorrelation value of an output voice signal; an autocorrelation value temporary storage circuit for storing the output of the signal processor; a minimum value detecting circuit for detecting a minimum of the autocorrelation values stored in the storage circuit, whereby the pole parameter corresponding to the minimum autocorrelation value is extracted.

3 Claims, 6 Drawing Figures

$V_i^{m,j} = r_i^{m-1,j}$ , $E_{M,j} = r_0^{M,j}$ $\alpha_{m,k}$ ; k-th FORMANT CANDIDATE OF m-th FORMANT

SYSTEM FOR EXTRACTION OF POLE PARAMETER VALUES

BACKGROUND OF THE INVENTION

This invention relates to a system for the extraction of pole parameter values in the voice output frequency characteristic pattern to be used for the analysis-synthesis or the recognition of voices.

It is known that the frequency spectrum of the voice waveform has frequency components called formants at which energies are concentrated corresponding to the resonant frequencies of the vocal tract. It is also known that the formants substantially correspond to the pole parameters obtained by approximating the frequency spectrum of the voice waveform based on the total pole model. As a typical way of extracting the pole parameter (formant parameter) from the voice waveform, there is known the so-called AbS (analysis by synthesis) method in which frequency spectrum for various formant patterns are synthesized on the basis of a voice forming model, for approximation of the synthesized frequency spectrum to the spectrum of natural voice. Further as a way of extracting formants by use of the AbS type technique, there is known a method entitled "Automatic Formant Tracking by a Newton-Raphson Technique" by J. P. Olive. The Journal of the Acoustical Society of America, Vol. 50, No. 2 (Part 2), 1971, pp 661-670, which discloses rather close resemblance to a system of the present invention.

This proposal accomplishes the formant extraction by use of the least-square fit (equivalent to inverse filtering in the region of frequency. This method, however, has the disadvantage that it entails a huge volume of arithmetic operations and, therefore, prevents real-time processing with a practical circuit of a small scale.

As is well known, there is also available a method in which a multiplicity of pole parameter values are prepared, a voice signal is applied to an inverse filter using linear prediction coefficients derived from the various pole parameter values, and a pole parameter is determined which minimizes the error power obtained by accumulating squares of the output values from the inverse filter. More particularly, since the transfer function A(z) ($z=ej\omega T$, T: sampling period) obtained by approximating the frequency spectrum envelope of the voice waveform on the basis of the total pole model is expressed by the following formula:

$$A(z) = \prod_{m=1}^{M} H_m(z) = \prod_{m=1}^{M} \frac{1}{1 + \alpha_{1m}z^{-} + \alpha_{2m}z^{-2}} \quad (1)$$

where $\alpha_{1m} = -b_m^2$ $\alpha_{2m} = 2b_m \cos 2\pi f_m T$

M: number of poles $f_m$: frequency of pole $b_m$: bandwidth of pole $H_m(z)$: transfer function at the m-th pole, this method selects such a pole parameter as will minimize the energy (error power) of the output waveform obtained by passing the actual voice signal through the inverse filter of $A^{-1}(z)$ which is the reciprocal of the filter of the formula (1).

The inverse filter of $H_m^{-1}(z)$ corresponding to one formant, when two linear prediction coefficients $\alpha_{1m}$ and $\alpha_{2m}$ are given, delivers an output signal $e_n$ corresponding to an input signal $S_n$, which is expressed as:

$$e_n = S_n - \alpha_{1m}S_{n-1} - \alpha_{2m}S_{n-2} \quad (2)$$

The error power E, therefore, is given by the following formula:

$$E = \sum_{n=n_A}^{n_B} e_n^2 \quad (3)$$

where $n_A$ and $n_B$ are the first and last sampling numbers in the analysis window. It is known that the time width of the analysis window for the voice is required to be about 30 m.sec. If the voice waveform is sampled at 10 KHz, for example, then the length of the accumulation area ($n_B - n_A$) of the formula (3) is about 300. The calculation of the error power of the formula (3) for the linear prediction coefficients corresponding to the various pole parameter values, therefore, entails a huge volume of arithmetic operations. The combination of relevant prediction coefficients with respect to a total of four formants, for example, proves to be a highly troublesome work.

SUMMARY OF THE INVENTION

An object of this invention is to provide a system for the extraction of pole parameter values, capable of calculating the error power expressed by the aforementioned formula (3) with a small volume of arithmetic operations to determine the optimum pole parameter value.

Another object of this invention is to improve the accuracy of prediction of the pole parameter values successively.

Still another object of this invention is to reduce the dynamic range of the arithmetic circuit.

According to this invention, there is provided a system for the extraction of pole parameter values comprising:

an autocorrelation value calculating circuit receiving an input voice signal through a time window, for calculating an autocorrelation value $V_i$(i=0, 1, 2 . . . ) of the input voice signal within the time window;

a linear prediction coefficient memory circuit for storing linear prediction coefficients ($\alpha_1$, $\alpha_2$) corresponding to various pole parameter values;

a signal processor for receiving as its input the output value Vi of the autocorrelation value calculating circuit, performing thereon an arithmetic operation according to the following formula using the prediction coefficients ($\alpha_1$, $\alpha_2$) supplied by the linear prediction coefficient memory circuit:

$$r_i = (1+\alpha_1^2+\alpha_2^2)V_i - (\alpha_1-\alpha_1\alpha_2)V_{i+1} - (\alpha_1-\alpha_1\alpha_2)V_{i-1} - \alpha_2 V_{i-2} - \alpha_2 V_{i+2}$$

and delivering an output ($r_i$) representative of an autocorrelation value of an output voice signal;

an autocorrelation value temporary storage circuit for storing the output of the signal processor;

a minimum value detecting circuit for detecting a minimum of the autocorrelation values stored in the storage circuit, whereby the pole parameter corresponding to the minimum autocorrelation value is extracted.

The number of arithmetic operations to be involved can be greatly decreased by incorporating an arrangement for causing the prediction of pole parameter values to be made coarsely in the preceding stage and successively improving the accuracy of prediction of such values in the following stages.

DESCRIPTION OF PREFERRED EMBODIMENT

Figure 1:
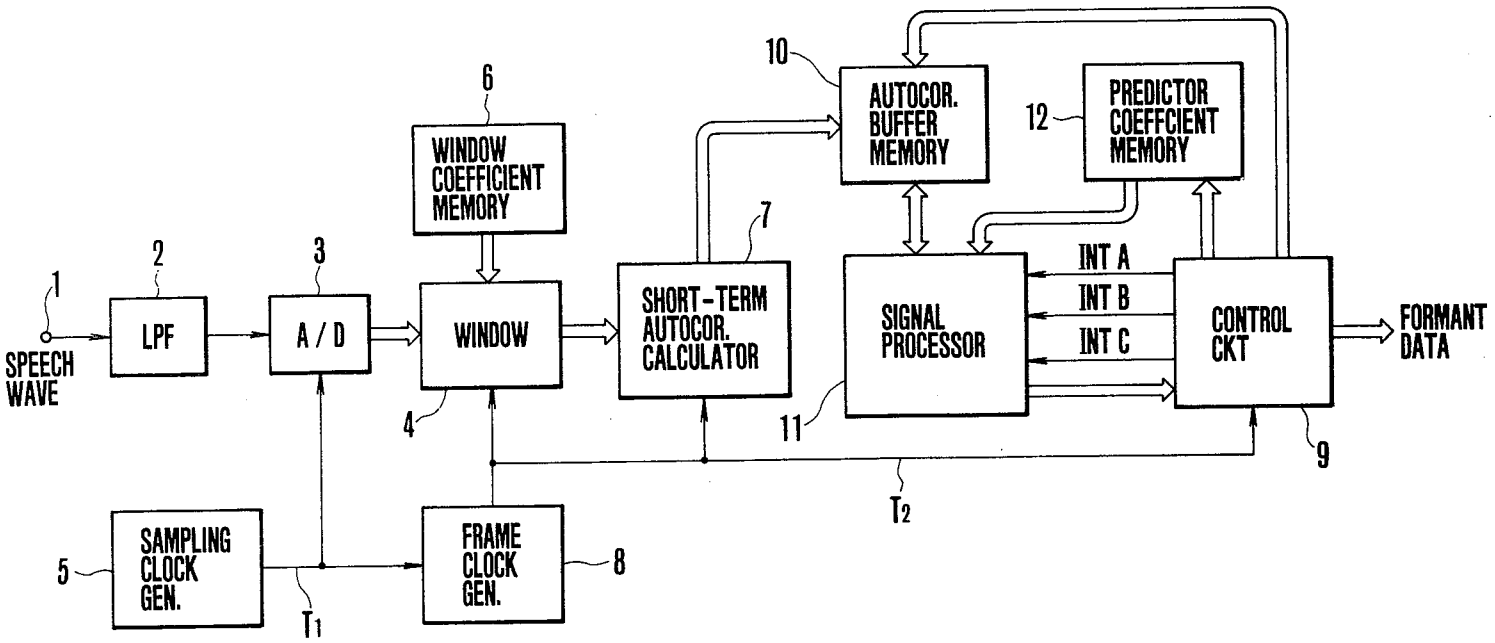
FIG. 1 is a block diagram illustrating a system for extraction of pole parameter values embodying the present invention.

Now, the principle of this invention will be described. For the output, $e_n$, of the inverse filter (so to speak, approximation error) given by the aforementioned formula (2), the autocorrelation value $r_i$ is given as follows:

$$r_i = \sum_{n=n_A}^{n_B} e_n e_{n-i} \tag{4}$$

where $e_{n-i}$ represents an output which precedes an output $e_n$ by i time slots. Thus, $r_0$ equals the error power E. By substituting the formula (2) in the formula (4) and developing the resultant formula, there is obtained the following equation:

$$\begin{aligned} r_i &= \sum_{n=n_A}^{n_B} (S_n - \alpha_1 S_{n-1} - \alpha_2 S_{n-2}) \times (S_{n-i} - \alpha_1 S_{n-i-1} - \alpha_2 S_{n-i-2}) \\ &= \sum_{n=n_A}^{n_B} (S_n S_{n-i} - \alpha_1 S_{n-1} S_{n-i} - \alpha_2 S_{n-2} S_{n-i} - \\ &\quad \alpha_1 S_n S_{n-i-1} + \alpha_1^2 S_{n-1} S_{n-i-1} + \\ &\quad \alpha_1 \alpha_2 S_{n-2} S_{n-i-1} - \alpha_2 S_n S_{n-i+2} + \\ &\quad \alpha_1 \alpha_2 S_{n-1} S_{n-i-2} + \alpha_2^2 S_{n-2} S_{n-i-2}) \end{aligned} \tag{5}$$

Since the analysis window (such as, for example, the hamming window) becomes 0 (zero) outside a fixed time interval and $S_n$ also becomes 0, it may be concluded that $S_n S_{n-i}$ equals $S_{n-1} S_{n-i-1}$, for example. The formula (5), therefore, may be reduced to formula (6) as below.

$$\begin{aligned} r_i = &(1+\alpha_1^2+\alpha_2^2)V_i - (\alpha_1 - \alpha_1\alpha_2)V_{i+1} \\ &-(\alpha_1 - \alpha_1\alpha_2)V_{i-1} - \alpha_2 V_{i-2} - \alpha_2 V_{i+2} \end{aligned}$$

where $$V_i = \sum_{n=n_A}^{n_B} S_n S_{n-i}$$

(i: number of time slots) . . . (7) In other words, $V_i$ is the autocorrelation value of the input signal $S_n$. Owing to the nature of the analysis window, $V_i = V_{-i}$ is satisfied. From the autocorrelation value $V_i$ of the input signal $S_n$ and the linear prediction coefficients $\alpha_1$ and $\alpha_2$, therefore, the aforementioned error power $$\sum_{n=n_A}^{n_B} e_n^2,$$

namely, $r_0$ can be determined.

Where there are involved a plurality of poles, the final $r_0$ can be determined by substituting the $r_i$ obtained by the formula (6) for the term $V_i$ in the righthand term of the formula (6) to find a new $r_i$ and repeating this procedure. When four formants are involved, for example, $r_0, \ldots, r_6$ for the first formant are determined based on the autocorrelation values $V_0, \ldots, V_8$ for the voice input signal $S_n$ with respect to $i=0, 1, \ldots, 8$. Then, for the second formant, $r_0, \ldots, r_4$ are determined by substituting the aforementioned $r_0, \ldots, r_6$ for the $V_i$ in the righthand term of the formula (6). In the same manner, the $r_0$ or the error power $\Sigma e_n^2$ which collectively reflects the third and fourth formants can be determined. By the operation described above, the error power $\Sigma e_n^2$ for each of the various pole parameters can be determined and the particular pole parameter that gives a minimum of all the error powers can be extracted. Since the arithmetic operation according to the formula (6) has a value of about 300 for $(n_B - n_A)$, the number of multiplications and additions involved are notably smaller than that involved in the calculation of error powers by use of the aforementioned formulas (2) and (3).

There is another advantage that the aforementioned arithmetic operation need not be performed on all the pole parameter values involved. The number of arithmetic operations to be performed until the final extraction can be notably decreased by first finding a minimum error power with respect to roughly quantized pole parameter values to determine coarse pole parameter values and successively heightening the accuracy of the pole parameter value. Assuming that the number of formants is M and the pole parameter value is to be selected from F pole parameter values prepared in advance for each of the formants, the number of arithmetic operations required will be $F^M$ if the arithmetic operations are performed on all the combinations possible at all. In a typical case involving $M=4$ and $F=32$, the number of arithmetic operations required will amount to $32^4$. In accordance with this method, it is possible to perform coarse prediction on the pole parameters at first and, by using the results of the coarse prediction, perform successively fine prediction in the following steps. To be more specific, in the preceding step, the optimum value is determined by the combination of various poles with respect to a small number of roughly quantized parameter values taken from the aforementioned F pole parameter values. Then, in the subsequent step, the prediction of the pole parameter value is carried out on the limited small poles in the neighborhood of the pole parameter value found in the preceding step. In other words, this operation is fulfilled by representing the F parameters in quantized codes, finding the optimum value with respect to the uppermost bits in the preceding step, and successively finding the optimum value with respect to the lowermost bits by utilizing the results of the preceding step. Let L stand for the number of divided steps and K for the quantizing level of each pole in each step, the pole parameter value will be predicted with high accuracy by fixing L, the number of divided steps, to the order of $L=\log_K F$. Consequently, the pole parameter value can be determined by carrying out about $K^M \times L$ error power calculations. Assume a typical case wherein $M=5$, $F=32$, and $K=2$, and the number, L, of divided steps will be about 5 (since $K=2$, the accuracy of prediction can be doubled for each step). In this case, therefore, the pole parameter value can be predicted by about 160 ($K^2 \times L = 2^5 \times 5 = 160$) error power calculations.

Further in the prediction of the pole parameter value, a constraint can easily be formed as for the limitations of the range of prediction. This fact offers the advantage that possible abrupt discontinuation of pole parameter values can be precluded by limiting the range of the prediction of pole parameter values in the present analysis frame with reference to the result of the prediction in the past analysis frame.

In the preceding description, only $\alpha_1$ and $\alpha_2$ have been treated as the linear prediction coefficients. Even in the case using prediction coefficients of at least third order, it is apparent that the pole parameter value can be determined by the same manner to obtain the same effect.

Further in accordance with the present invention, the dynamic range of the autocorrelation value can be decreased by normalizing the autocorrelation value of the output of the aforementioned inverse filter by the use of the value of power, so that tolerance of the accuracy required for the arithmetic operations can be relieved and the arithmetic operations involved can be effectively handled with a general-purpose signal processor. Described hereinafter will be the principle for normalizing the autocorrelation values.

When the autocorrelation value obtained in the m−th inverse filter circuit corresponding to the m−th formant is represented by $r_i^m$ ($m=1, 2, \ldots, M$; M represents the number of formants to be extracted), the normalized autocorrelation value $V_i^{m+1}$ given as the input to the (m+1)−th inverse filter will be represented as follows.

$$V_i^{m+1} = \frac{r_i^m}{r_0^m}, \ (i = 1, 2, \ldots I) \tag{8}$$

where I represents the order of the autocorrelation coefficients found necessary for the (m+1)-th arithmetic operation and the normalization factor $r_0^m$ represents the autocorrelation value delivered out of the m−th inverse filter circuit at a time lag of zero, namely, the value of power. The input $V_i^1$ to the 1st inverse filter is obtained by dividing the autocorrelation value $V_i$ of the input waveform by the value of the corresponding power (normalization factor) $V_0$ and written as:

$$V_i^1 = \frac{V_i}{V_0} \tag{9}$$

The final value of power (error power value) $E_M$ to be obtained in consequence of M steps of inverse filtering without normalization, therefore, is expressed by the following formula (10):

$$E_M = V_0 r_0^1 r_0^2 \ldots r_0^{M-1} r_0^M \tag{10}$$

where $r_0^M$ represents the value of power delivered out of the M−th inverse filter. The error power E, therefore, is obtained by multiplying the individual normalization factors $V_0$, $r_0^1$, . . . , $r_0^{M-1}$ by the final step output $r_0^M$. Desired comparison of error powers, therefore, can be effected by the addition of the logarithmic values of the individual normalization factors and the value of the final power. Since each inverse filter circuit has received the normalized correlation value, it will function sufficiently with a small dynamic range. Thus, the present invention permits a notable reduction of the size of the arithmetic operation circuit.

According to the normalization as described so far, the present invention effects the calculation of the final error power by subjecting the autocorrelation value of the voice waveform input to the inverse filtering through the medium of the linear prediction coefficients, applying the autocorrelation value delivered out of the inverse filter of the first step to the inverse filter of the next step, and repeating the procedure just described as many times as the number of pole parameters involved. It is, therefore, apparent that since the inverse filters in the successive steps are constructed so as to receive as their inputs the autocorrelation values normalized with the values of power, dynamic range of the inverse filters can be decreased and the scale of the arithmetic operatin circuit can be drastically reduced.

The invention will now be described by way of example with reference to the accompanying drawings.

Figure 2:
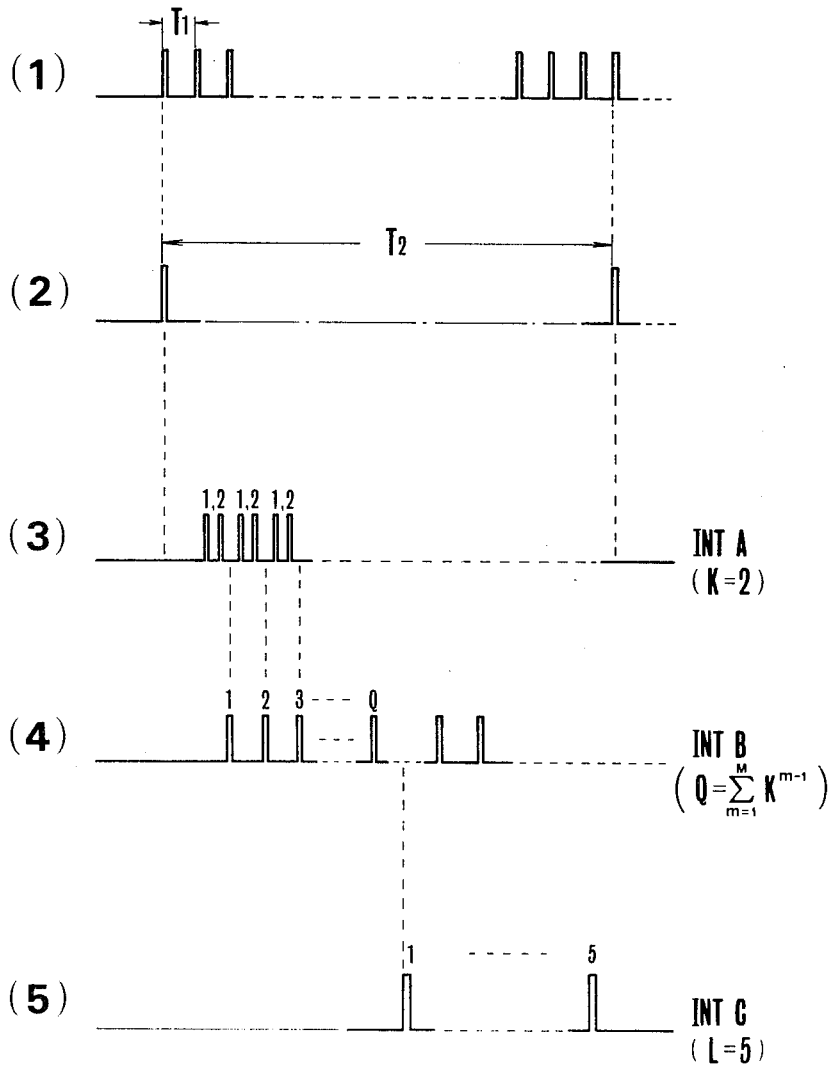
FIG. 2 is a time chart of principal control signals involved in the embodiment of FIG. 1.

FIG. 1 is a block diagram illustrating an extraction system embodying this invention. First, a voice waveform applied to a voice waveform input terminal 1 is subjected to low-pass filtering at a low filter 2, then converted into a digital signal by an A/D converter 3, and fed to a window circuit 4. The A/D converter 3 is controlled by a sampling clock pulse of a period $T_1$ generated by a sampling clock generator 5 and is caused to effect A/D conversion for each cycle of the sampling clock pulse. The waveform of the sampling clock pulse is shown at section (1) in FIG. 2. Generally, the period of the sampling clock pulse is of the order of 100 to 130 sec. Then, the window circuit 4 multiplies the voice waveform signal already converted into the digital signal by the coefficient read out of a window coefficient memory 6 to give birth to a hamming window and delivers out the resultant product to a short-term autocorrelation coefficient calculating circuit 7. The window processing by the window circuit 4 is carried out for each frame period in accordance with a frame period pulse of a period $T_2$ generated by a frame period pulse generating circuit 8. The frame period pulse generating circuit 8 divides the aforementioned sampling clock pulse to produce the frame period pulse and supplies the frame period pulse to the window circuit 4, the autocorrelation coefficient calculating circuit 7, and a control circuit 9. The waveform of the frame period pulse is shown as at section (2) in FIG. 2. Generally, the period of the frame period pulse is of the order of 10 to 20 m. sec. The short-term autocorrelation calculating circuit 7 which is controlled by the frame period pulse calculates the autocorrelation coefficient of the output waveform of the window circuit 4 for each frame period (Formula 7) and delivers the autocorrelation coefficient to an autocorrelation buffer memory 10. The window circuit 4 and the autocorrelation coefficent calculating circuit 7 are described in detail in an article "Digital Inverse Filtering—A New Tool for Formant Trajectory Estimation" by J. D. Markel, IEEE TRANSACTIONS ON AUDIO AND ELECTROACOUSTICS, Vol. AU-20, No. 2, June, 1972, pp 129–136 and will not be detailed herein for avoiding prolixity of description.

Figure 3:
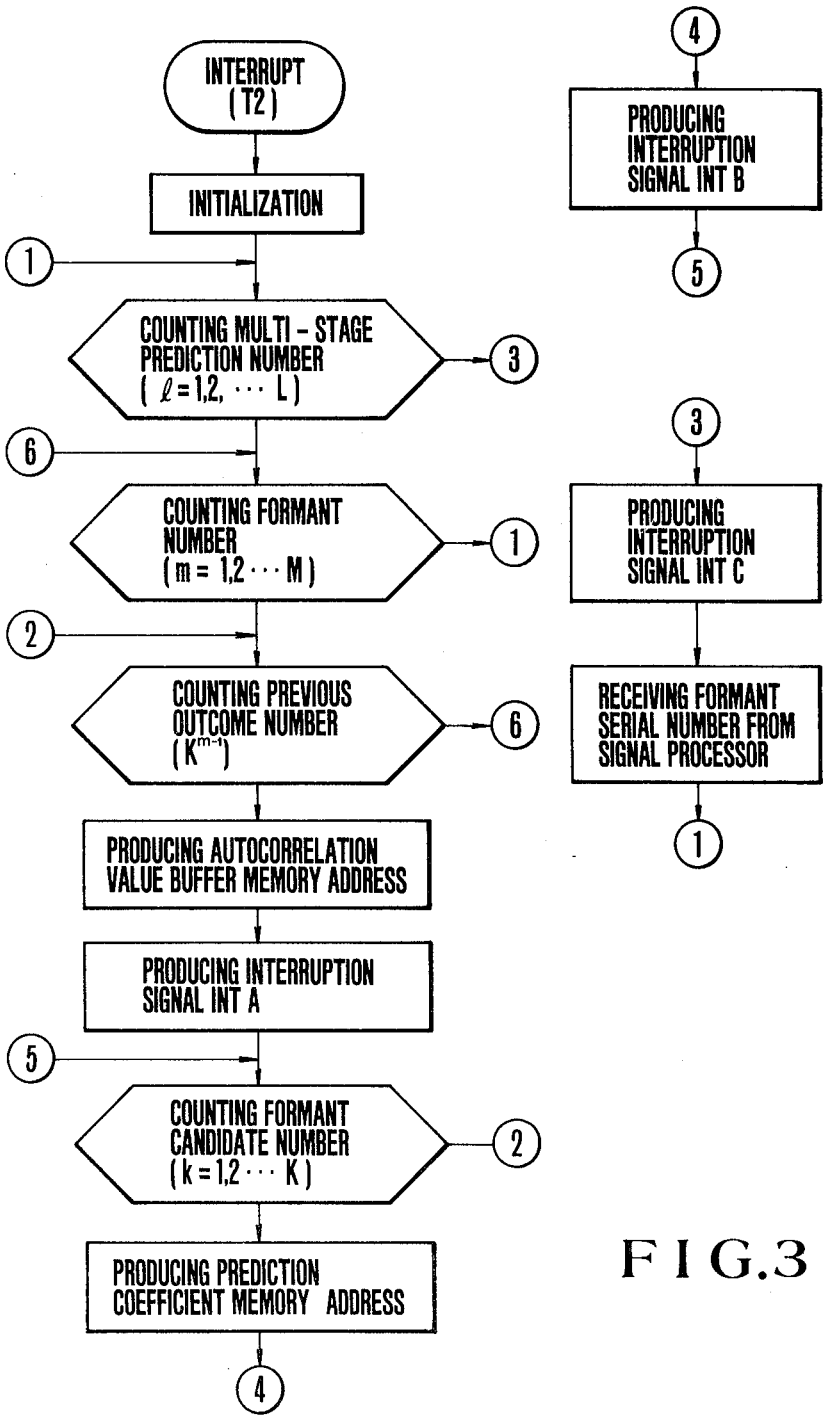
FIG. 3 is a flow chart illustrating the operation of a control circuit in the embodiment of FIG. 1.
Figure 4:
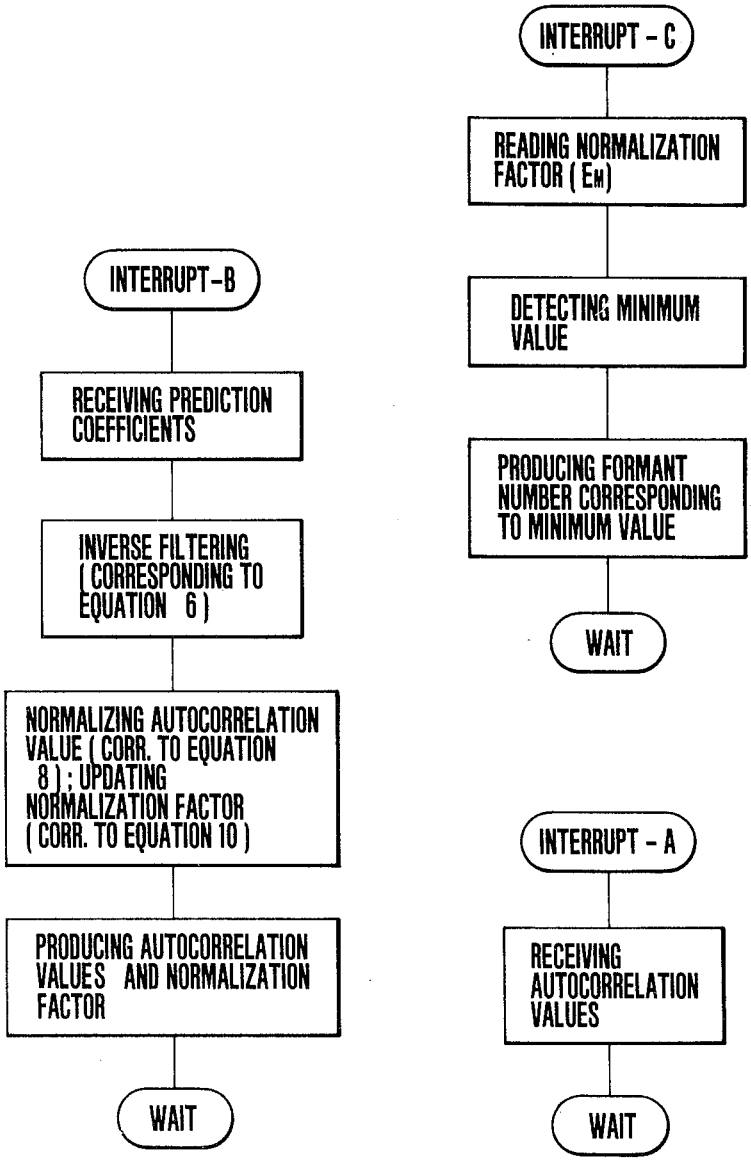
FIG. 4 is a flow chart illustrating the operation of a signal processor with normalization of autocorrelation values in the embodiment of FIG. 1.
Figure 5:
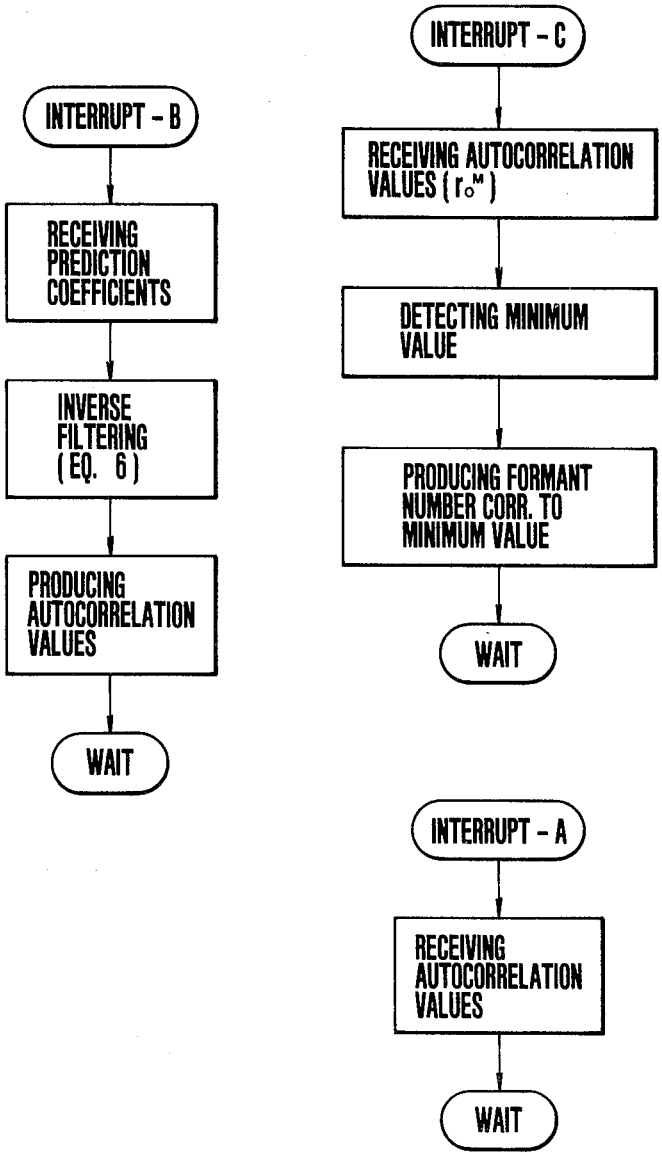
FIG. 5 is a flow chart illustrating the operation of a signal processor without normalization of autocorrelation values in the embodiment of FIG. 1.

Subsequently, the extraction of formant parameter from the autocorrelation values is effected by using the control circuit 9 and a signal processor 11. The flow chart of the processing performed in this case by the control circuit 9 is illustrated in FIG. 3. FIGS. 4 and 5 illustrates the flow chart of the processing performed by the signal processor.

Now, each formant has 64 formant candidates, for example. To each formant candidate is allocated a quadratic linear prediction coefficient $\alpha_{m,k}$. Here, $\alpha_{m,k}$ represents the linear prediction coefficient which corresponds to the k−th formant candidate of the m−th formant. This means that a total of 64 sets of coefficients exist for the 64 formant candidates of each formant. In the description given below, the number, M, of formants is set to 3, the number, L, of dividing steps to 5, and the number, K, of coefficients to be selected in each dividing step to 2 (two coefficients are selected from the set of 64 coefficients) and the autocorrelation values are not normalized with the corresponding values of power.

Figure 6:
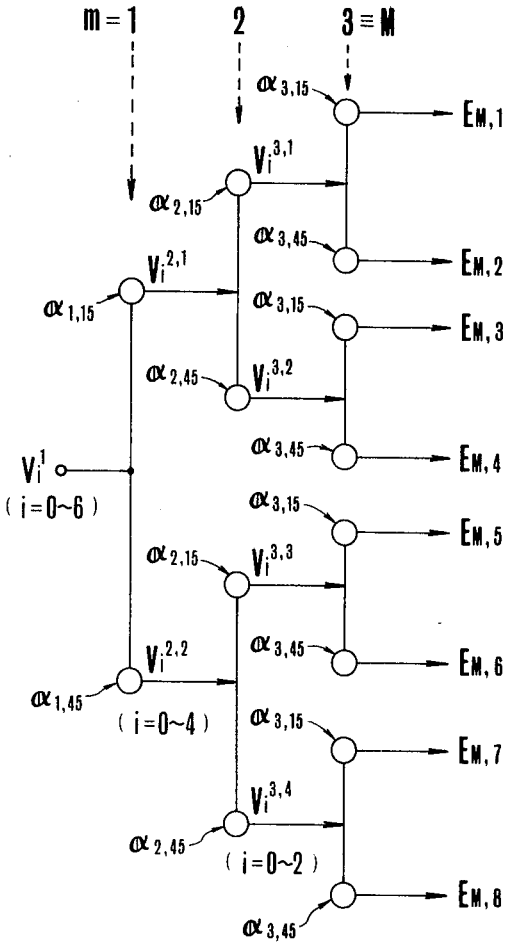
FIG. 6 is a connection diagram illustrative of the processing for one stage.

First, the control circuit 9 applies an address to a memory 12, reads out of the memory 12 the two prediction coefficients $\alpha_{1,15}$ and $\alpha_{1,45}$ corresponding to the two predetermined formant candidates (15th and 45th formant candidates in the present case) and applies them to the processor 11. It then reads out of the memory 10 the autocorrelation values $V_i^1(V_0^1-V_6^1)$ and applies them to the processor 11. The processor 11 calculates the autocorrelation values of the first formant in accordance with the formula (6) using $V_0$ to $V_6$ and $\alpha_{1,15}$ and $\alpha_{1,45}$. This corresponds to m=1 in FIG. 6. The autocorrelation values found here are $V_i^{2,1}$ and $V_i^{2,2}$, which are used as the input for the arithmetic calculation for the second formant. In the same manner, the autocorrelation values of the second formant are found in accordance with the formula (6) using the prediction coefficients $\alpha_{2,15}$ and $\alpha_{2,45}$ for the two predetermined formant candidates of the second formant and the autocorrelation values $V_i^{2,1}$ and $V_i^{2,2}$. The values found are $V_i^{3,1}$ to $V_i^{3,4}$, which are used as the input for the third formant. This corresponds to m=2 in FIG. 6.

Similarly, the autocorrelation values of the third formant are determined in accordance with the formula (6). The values ($r_0$) thus found correspond to the error powers $E_{M,1}$ to $E_{M,8}$. The formant candidate (the 15th candidate for the first formant and the 45th candidate for each of the second and third formants) which has the coefficients $\alpha_{1,15}$; $\alpha_{2,45}$; $\alpha_{3,45}$ corresponding to a minimum (such as, for example, $E_{M,4}$) of the error powers mentioned above is the formant of the step of L=1. The formant obtained in the first step is of an estimated value. In the step L=2, therefore, the coefficients slightly deviating from $\alpha_{1,15}$; $\alpha_{2,45}$; and $\alpha_{3,45}$ such as, for example, $\alpha_{1,13}$ and $\alpha_{1,17}$ which fall before and after $\alpha_{1,15}$ are selected for the first formant for the purpose of improving the accuracy of prediction. Similarly, $\alpha_{2,43}$ and $\alpha_{2,47}$ are selected for the second formant and $\alpha_{3,43}$ and $\alpha_{3,47}$ are selected for the third formant respectively. The processing which follows the selection of these coefficients is the same as in the first step. From the coefficient obtained in the second step, those to be used in the third step are selected. This procedure is repeated until the step of L=5. The prediction coefficient to be obtained in the fifth step in the manner described above forms the final formant.

Now, the operation involving the normalization of the autocorrelation values will be described.

The control circuit 9 repeats the same processing for each frame period in accordance with the frame period pulse. The control circuit 9 applies interruption signals IntA, IntB, and IntC, indicated at sections (3), (4) and (5) in FIG. 2, to the signal processor. At the same time, it delivers the address data to the prediction coefficient memory 12 and the autocorrelation value buffer memory 10. Further, the control circuit 9 receives formant data from the signal processor, generates the formant candidate data in the step following the last of the multiple steps involved in the preceding prediction (which correspond to the address data for the aforementioned prediction coefficient memory), and in the final step produces the formant data as the result of the formant extraction through the formant data output terminal.

On the other hand, the signal processor 11 receives the prediction coefficient values ($\alpha_1$ and $\alpha_2$) from the prediction coefficient memory 12 in accordance with the interruption signal IntA delivered out of the control circuit 9. It further receives the autocorrelation values ($V_i$) from the memory 10 in accordance with the interruption signal IntB, effects the inverse filtering conforming to the formula (6), normalizes the produced autocorrelation values by the processing conforming to the formulas (8) and (10), and thereafter delivers the products of normalization together with the normalization factors to the autocorrelation value buffer memory 10. It further reads in the autocorrelation values (power values) and the normalization factors from the autocorrelation value memory 10 in accordance with the interruption signal IntC, detects a minimum of these values, and produces the serial number of the formant corresponding to the minimum of the values as the formant data to the control circuit 9.

As the signal processor in this system, a processor may be used which is disclosed in an article "A Single-Chip Digital Signal Processor for Voiceband Applications" by Yuichi Kawakami et al, 1980 IEEE International Solid-State Circuits Conference.

What is claimed is:

1. A system for the extraction of pole parameter values comprising;

an autocorrelation value calculating circuit receiving an input voice signal through a time window, for calculating an autocorrelation value $V_i$(i=0, 1, 2, . . . ) of the input voice signal within the time window;

a linear prediction coefficient memory circuit for storing linear prediction coefficients ($\alpha_1$, $\alpha_2$) corresponding to various pole parameter values;

a signal processor for receiving as its input the output value $V_i$ of said autocorrelation value calculating circuit, performing thereon an arithmetic operation according to the following formula using the prediction coefficients ($\alpha_1$, $\alpha_2$) supplied by said linear prediction coefficient memory circuit:

$$r_i=(1+\alpha_1^2+\alpha_2^2)V_i-(\alpha_1-\alpha_1\alpha_2)V_{i+1}-(\alpha_1-\alpha_1\alpha_2)V_{i-1}-\alpha_2V_{i+2}-\alpha_2V_{i-2}$$

and delivering an output ($r_i$) representative of an autocorrelation value of an output voice signal;

an autocorrelation value temporary storage circuit for storing the output of said signal processor;

a minimum value detecting circuit for detecting a minimum of the autocorrelation values stored in said storage circuit.

2. An extraction system according to claim 1, wherein said pole parameter is quantized and memorized in a plurality of steps, the uppermost bits are read out for extraction of the minimum autocorrelation value in the preceding step, and the lowermost bits are read out with respect to the pole parameter corresponding to said minimum autocorrelation value in the subsequent step.

3. A system for the extraction of pole parameter values comprising:

an autocorrelation value calculating circuit receiving an input voice signal through a time window, for calculating an autocorrelation value $V_i(i=0, 1, 2 \ldots)$ of the input voice signal within the time window, a minimum of said input voice signal autocorrelation values representing a power value of the input signal;

formant data storage means for storing various pole parameter values and corresponding linear prediction coefficients;

a plurality of inverse filters, each stage of which performs a predetermined calculation based on the autocorrelation values of the input voice signal and the linear prediction coefficients to produce an autocorrelation value $r_i(i=1, 2, \ldots)$ of an output voice signal which in turn is applied to the subsequent stage, a minimum of said output voice signal autocorrelation values representing a power value of the output signal;

output power comparing means for detecting a minimum of power values delivered out of the last stage of said inverse filters and producing an address of said formant data storage means corresponding to the minimal power value; and normalization means for normalizing the input autocorrelation values $V_i$ to said inverse filters and the output autocorrelation value $r_i$ from each stage of said inverse filters with the corresponding power values, whereby said inverse filters employ the normalized autocorrelation values for the predetermined calculation.

* * * * *

UNITED STATES PATENT AND TRADEMARK OFFICE

CERTIFICATE OF CORRECTION

PATENT NO. : 4,486,899

DATED : Dec. 4, 1984

INVENTOR(S) : Fushikida

It is certified that error appears in the above-identified patent and that said Letters Patent is hereby corrected as shown below:

| COLUMN | LINE | DESCRIPTION |
|---|---|---|
| 1 | 53 | Please delete |

$$"A(z)=\prod_{m=1}^{M} H_m(z) = \prod_{m=1}^{M} \frac{1}{1 + \alpha_{1m} z^{-} + \alpha_{2m} z^{-2}}"$$

and insert in lieu thereof $$--A(z) = \prod_{m=1}^{M} H_m(z) = \prod_{m=1}^{M} \frac{1}{1 + \alpha_{1m} z^{-1} + \alpha_{2m} z^{-2}}--$$

Signed and Sealed this

*Third* Day of *September 1985*

[SEAL]

*Attest:*

DONALD J. QUIGG

*Attesting Officer* *Acting Commissioner of Patents and Trademarks - Designate*